United States Patent [19]

Ruklic

[11] 4,437,574

[45] Mar. 20, 1984

[54] TAMPER-RESISTANT BOTTLE CAP

[76] Inventor: William Ruklic, 549 Chestnut La., Beecher, Ill. 60401

[21] Appl. No.: 311,307

[22] Filed: Oct. 14, 1981

[51] Int. Cl.[3] ..... B65D 41/46

[52] U.S. Cl. ..... 215/247; 215/256; 215/307; 220/270

[58] Field of Search ..... 215/256, 247, 254, 253, 215/307; 220/270, 254

[56] References Cited

U.S. PATENT DOCUMENTS

| | | | |
|---|---|---|---|
| 3,032,226 | 5/1962 | Terwilliger | 215/256 |
| 3,672,528 | 6/1972 | Faulstich | 215/256 |
| 4,281,774 | 8/1981 | Mumford | 215/256 X |

FOREIGN PATENT DOCUMENTS

| | | | |
|---|---|---|---|
| 2035274 | 6/1980 | United Kingdom | 215/256 |

*Primary Examiner*—Donald F. Norton

*Attorney, Agent, or Firm*—Alexander & Zalewa, Ltd.

[57] ABSTRACT

A plastic closure or cap of the tamper indicating type for sealing a container has collar means that frictionally grasp the rim of the container and an outer collar part which has a latch cooperating with a catch on the rim. The cap has a pull tab which facilitates tearing the collar part from the rim to separate the latch from the catch. The cap also has a material receiving opening having an irremovable closure plug. The plug may be carried by a tongue attached to the cap or it may be independent of the cap. The material receiving opening may have a lower end portion closed by a wall that may be penetrated by a hollow needle to fill the container.

25 Claims, 10 Drawing Figures

TAMPER-RESISTANT BOTTLE CAP

SUMMARY OF THE INVENTION

The gist of this invention is to provide a bottle cap of one-piece molded construction which, at the point of attachment to the bottle, engages both the inside and outside of the bottle opening in such a manner as to render the closure extremely difficult to pry off and provides a positive seal against the possibility of leaking of the bottle contents. This is accomplished by providing the closure with a double collar comprising inner and outer rings, the inner of which frictionally engages the inside of the bottle opening and the outer of which attaches to the outside of the bottle opening, the outer collar being constructed with a pull tab arranged so that when the contents of the bottle are to be used, pulling the pull tab peripherally of the bottle opening will tear away the outer collar of the cap and free the cap for "twist-off" removal from the bottle.

It is intended that the bottle be filled after the molded cap has been applied and for that purpose, the top of the cap is formed with an opening providing access to the interior of the bottle, the opening having an inwardly-extending extending collar which includes a molded circumferential locking and sealing ring on its inner wall adapted to engage a closure plug which, in turn, has a mating ring molded on it so that when the plug is snapped into the opening, it cannot be pulled out.

In one form of the invention, the closure plug is integral on and carried by an outwardly-extending tongue integral with the cap and so disposed that by bending the tongue over onto the top of the cap, the plug can be inserted in the filler opening to seal the same. In this arrangement, the closing tongue is fitted to the surface of the cap in such a manner as to make it difficult to insert a knife or any sharp object to pry the closure plug open. In another form of the invention, the closure plug is a separate element which, when inserted into the well in the bottle cap, becomes permanently locked in place with its top end fitted to the top surface of the cap in such a manner as to serve to prevent the plug being pried out. In another form of the invention, the inwardly-extending collar located on the top of the cap is closed off at the bottom of said collar by a bottom wall adapted for filling the bottle by means of a hollow needle inserted through said bottom.

BRIEF DESCRIPTION OF THE DRAWINGS

Specific embodiments of this invention are shown in the accompanying drawings, in which.

DESCRIPTION OF THE PREFERRED EMBODIMENT

Figure 1:
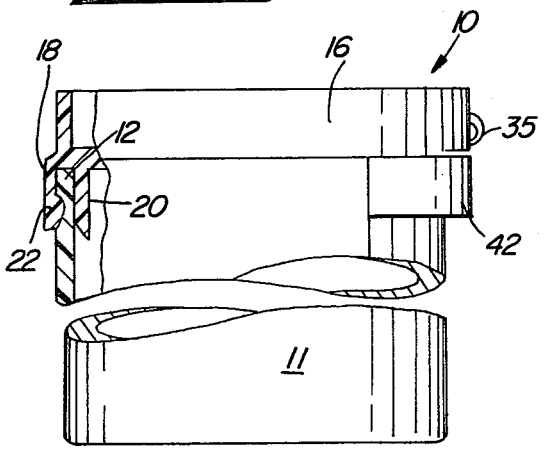
FIG. 1 is a partly sectioned view showing the bottle and closure cap combination with the cap locked and sealed to the bottle.
Figure 2:
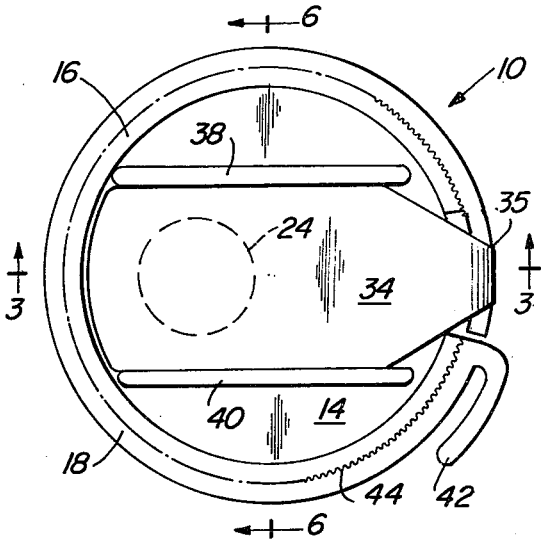
FIG. 2 is a top view of the closure cap when applied to the bottle in closing relation.

As shown in FIGS. 1 to 6, inclusive, the improved bottle cap 10 is a molded construction adapted to be fitted onto the open end of a conventional cylindrical bottle 11 and secured thereto by engagement with an annular bead or catch 12 integral on the said bottle at its open end. In the form shown, the improved closure cap comprises a top wall or platform 14 having a peripheral upstanding collar 16 and a pair of depending radially-spaced collars 18 and 20 which are adapted to receive between them the open end of the cylindrical bottle 11.

A particular feature of this improved bottle cap resides in the inner collar 20 being made slightly greater in its external diameter than the inside diameter of the bottle 11, for example about two thousandths of an inch, whereby the collar 20 will be in tight frictional engagement with the inner surface of the bottle 11 when the cap is applied thereto. The external or outer depending collar 18 is also proportioned to closely fit the external surface of the open end of the bottle 11 and is provided with a latch 22 adapted to engage beneath the catch 12 on the bottle 11. With this arrangement, when the cap 10 is applied to the bottle 11, it becomes securely fixed thereto, so that it cannot be pulled or pried away from the open end of the bottle and can only be removed by breaking away the depending outer collar 18 in its entirety by the use of pull tab 42.

In the form shown, the platform 14 of the improved bottle cap is provided with an annular opening 24 which is surrounded by a depending cylindrical wall 26 which, on its inner surface, is provided with a latching groove 28 adapted to be engaged by a peripheral external catch 30 formed on the outer surface of a closure plug 32.

With this arrangement of cap opening 24 and closure plug 32, the bottle 11 can be filled and sealed after the molded closure cap 10 has been applied to the open end of the bottle and once the closure plug 32 has been forced into the filler opening 24 of the bottle cap, the bottle becomes firmly sealed and its contents is secure against tampering of any kind.

In the form of the improved bottle cap shown in FIGS. 1 to 6, inclusive, the closure plug 32 for the filler opening 24 is normally part of and carried by an outwardly-projecting tongue 34 which extends from the platform 14 or cap top as an integral part thereof, the tongue 34 being foldable about its juncture 35 with the platform 14 so as to closely overlie the upper surface of the platform 14 and present the plug 32 to the opening 24 whereby the plug 32 can be forced into the opening 24 to firmly seal the same. To facilitate this very close folding of the tongue 34 against the upper surface of the platform 14, the under side of the tongue 34 at the platform connection 35 is formed with a groove 36 which has a depth of substantially half the thickness of the tongue 34. This is clearly shown in FIG. 5.

Figure 3:
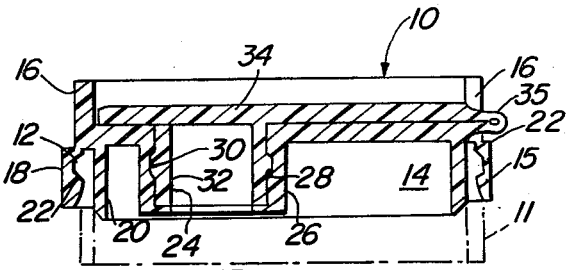
FIG. 3 is a sectional view through the bottle cap and the upper end of the bottle as taken on line 3—3 of FIG. 2.
Figure 4:
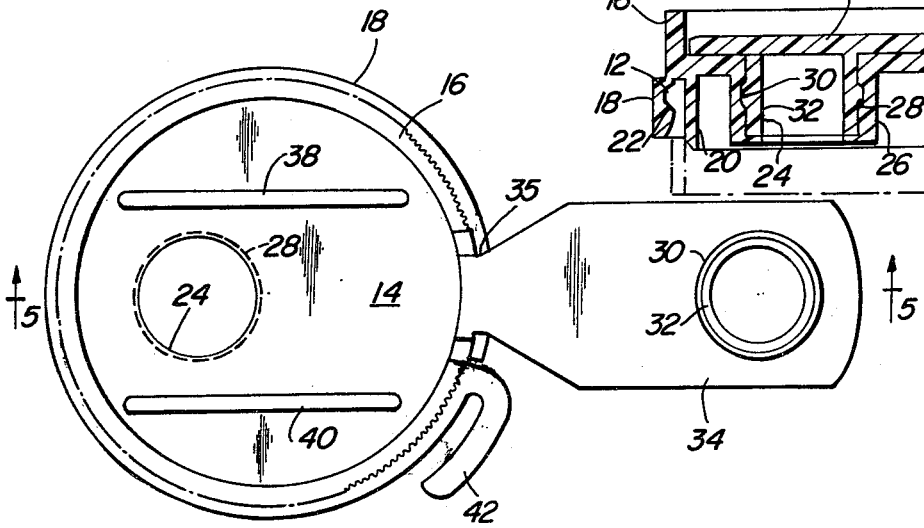
FIG. 4 is a top plan view of the closure cap before use.
Figure 5:
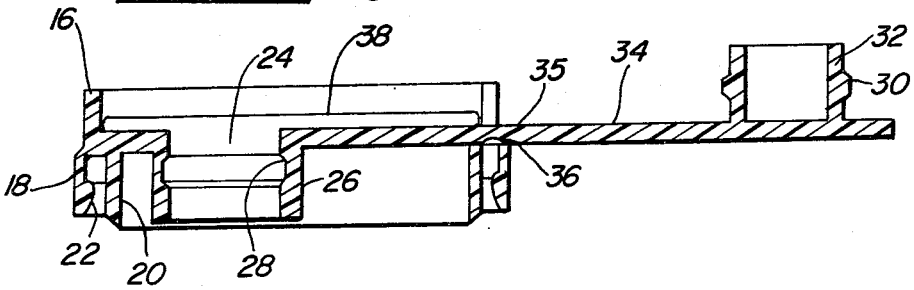
FIG. 5 is a sectional view of the same as taken on line 5—5 of FIG. 4.

As shown in FIGS. 1 to 6 and to secure the closure plug 32 against being pried out of the opening 24, a pair of upwardly-projecting ribs 38 and 40 are provided on the platform or cap top 14, equally spaced on each side of the opening 24, for reception of the tongue 34 between them when the tongue is folded over onto the upper surface of the cap top. The height of the ribs 38 and 40 is substantially the same as the thickness of the tongue 34 and the two ribs are spaced apart a distance of about four hundreths of an inch, or less, greater than the width of the tongue 34 so as to inhibit the introduction of a knife blade under the tongue 34 adjacent the plug 32 for the purpose of prying the plug out of the filler opening 24. Also, for the same purpose, the length of the tongue 34 is made so as to extend beyond the plug 32 to substantially reach the inner surface of the upstanding collar 16 as shown in FIG. 3.

For removal of the improved cap from the bottle 11, it is necessary to tear away the latching ring 18 at the lower portion of the cap 10 and to facilitate this action, the depending peripheral collar 18 is arranged to form a substantially complete circle with one side terminating immediately adjacent to a pull tab 42 which is formed at the other end of the collar 18 whereby the collar 18 can be broken away from the platform 14 and torn away peripherally to free the cap 10 from the bead or catch 12. This frees the cap 10 for a relatively easy twist-off removal from the bottle 11 against the friction of the tight engagement of the inner depending collar 20 with the inner surface of the bottle 11. To facilitate this twist-off removal of the cap 10 from the bottle 11, the periphery of the upstanding collar 16 of the cap 10 is knurled to provide a firm gripping surface, as indicated at 44 in FIG. 2.

Figure 7:
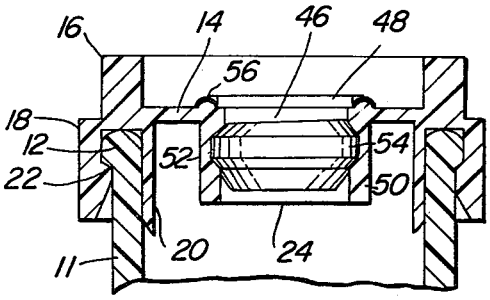
FIG. 7 is a partly sectioned view showing a modified form of the closure cap.
Figure 8:
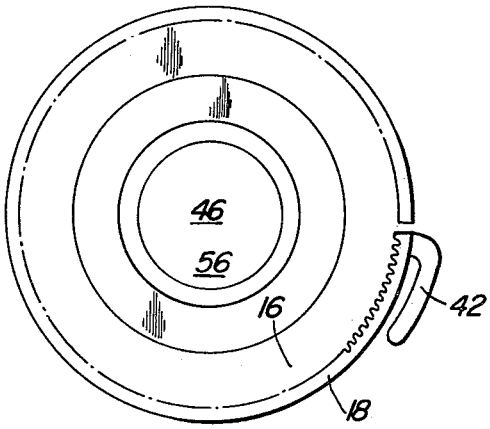
FIG. 8 is a top plan view of the same.
Figure 9:
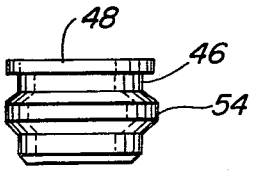
FIG. 9 is an elevational view of the closure plug used in the modified form of closure cap.
Figure 6:
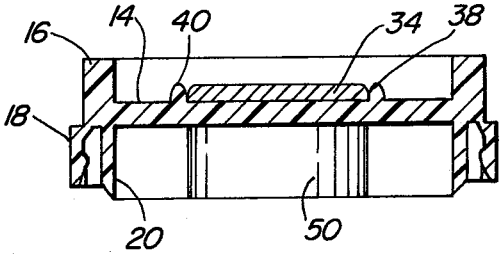
FIG. 6 is a sectional view as taken on line 6—6 of FIG. 2.

The modified form of the improved bottle cap shown in FIGS. 7 to 9, inclusive, is of substantially the same construction as that shown in FIGS. 1 to 6 except that the tongue and closure plug carried thereby have been entirely omitted and the filler opening 24 has been located in the center of the cap top or platform 14. In this form of the device, the closure plug 46 is a separate and independent element and is provided with a head 48 to seat on the margin of the filler opening 24. Also, the depending collar or wall 50 of the filler opening 24 is provided with a catch 52 for a latching rib 54 on the plug 46 so that once the plug has been inserted in the filler opening, it becomes securely locked in place. To prevent the plug 46 from being surreptitiously pried out of the filler opening, the margin of the opening is surrounded by an upstanding rim or bead 56 of the same height as the thickness of the head 48 of the closure plug 46, the inside diameter of the rim 56 being substantially the same as the outside diameter of the head 48. In this form of the device, the removal of the modified bottle cap from the bottle 11 is performed in substantially the same manner as originally stated. The depending peripheral collar 18 is torn away peripherally to free the cap 10 from the bead or catch 12 by the use of the pull tab 42. The periphery of the upstanding collar 16 of the cap 10 is knurled to provide a firm gripping surface as indicated in FIG. 8.

Figure 10:
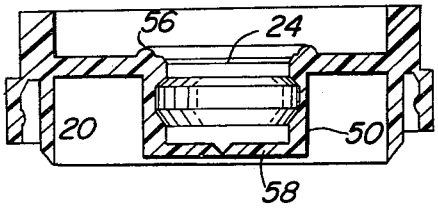
FIG. 10 is a sectional view of a further modification of the closure cap with the closure plug removed and showing a transverse wall across the bottom of the filler opening adapted for filling the bottle by means of a hollow needle.

In the form of the bottle cap shown in FIGS. 1 to 8, the filler openings 24 and their respective internal collars 26 and 50 are open from end-to-end for easy filling. In some cases, however, it may be desirable to fill the bottle or receptacle with a fluid best introduced by means of a hollow needle and for that purpose, the bottom end of the inner walls 26 and 50 may be closed off by a transverse wall 58, as shown in FIG. 10, which is relatively thin, for example, about twelve thousandths of an inch thick, and in the center of this wall, a groove is formed with a depth about three-quarters of the wall thickness. It is at this point that a needle can be punctured through the wall 58 to effect filling of the receptacle in a substantially self-closing needle puncture.

From the foregoing, it will be seen that there is provided a fully tamper-resistant closure cap for a conventional form of receptacle or bottle so that once the receptacle has been filled, its contents are safe and secure against contamination or surreptitious removal. Generally, the bottles or receptacles are made of a suitable plastic material and it is intended that the improved closure caps are to be molded from a plastic material that is to be substantially rigid when formed and for that purpose, it is suggested that the improved closure caps be molded from high density polyethylene material.

Although several embodiments of this invention have been herein shown and described, it will be understood that details of the constructions shown may be altered or omitted without departing from the spirit of this invention as defined by the following claims.

I claim:

1. A tamper resistant closure cap for a cylindrical receptacle open at one end and having a peripheral outwardly-projecting catch at the open end, said cap having a top wall comprising:

(a) an annular platform having a pair of radially-spaced, peripherally-extending collars depending from its bottom surface, the inner of said depending collars having an outer diameter substantially the same as the inside diameter of said receptacle but gauged for engagement with the inner surface of the receptacle, and the outer one of said depending collars being gauged to fit the open end of the receptacle and having latch means on its inner surface gauged for snap-fit engagement with the catch means of said receptacle;

(b) means for removing the outer one of said depending collars of said closure cap; and (c) the top wall having an annular filler opening therein, and a closure plug being provided for said opening.

2. A closure cap according to claim 1 wherein the filler opening is surrounded by a depending cylindrical collar on the under side of the platform, said collar having an internal peripheral latching groove, and said closure plug has a peripheral external catch adapted to engage said latching groove when said closure plug is seated in said filler opening.

3. A closure cap according to claim 2 wherein the top wall of said cap has a radial tongue extending from its periphery, and said closure plug is attached on said tongue in position to engage in said filler opening when the tongue is folded inwardly and over said top wall.

4. A closure cap according to claim 3 wherein the top wall of the cap is provided with means to receive the tongue and peripherally enclose the same substantially flush with its upper surface when said plug is engaged in the filler opening so as to prevent insertion of a pry under the margin of the tongue for removal of the plug.

5. A closure cap according to claim 4 together with said platform having a peripherally-extending wall projecting from its upper surface and said wall having an inner surface wherein said tongue receiving and enclosing means comprises bars projecting from the upper surface of said top wall and extending parallel and immediately adjacent to closely receive the side edges of the tongue and the length of the tongue is made so as to extend beyond the closure plug to substantially reach the inner surface of the peripherally-extending wall projecting from the annular platform.

6. A closure cap according to claim 2 wherein said closure plug is a separate and independent element.

7. A closure cap according to claim 6 wherein means is provided on said top wall close to the periphery of said filler opening to prevent insertion of a pry for removal of said closure plug.

8. A closure cap according to claim 7 wherein the closure plug is provided with a head to seat on the filler opening and said means comprises an upstanding rim or bead of substantially the same height as the thickness of said head peripherally surrounding said head.

9. A closure cap according to claim 2 wherein the cylindrical collar of the filler opening is closed at its bottom by a transverse wall adapted for penetration by a hollow needle.

10. A closure cap according to claim 1 wherein the means for removing the outer depending collar comprises a pull tab located on said outer depending collar whereby the collar can be broken away from the platform and torn away peripherally of the cylindrical receptacle.

11. A closure cap according to claim 10 together with a peripherally-extending wall projecting upwardly from the annular platform wherein the peripherally-extending wall projecting upwardly from the annular platform is knurled to provide a firm gripping surface to facilitate the removal of the cap from the cylindrical receptacle.

12. A tamper resistant closure cap for a cylindrical receptacle open at one end and having a peripheral outwardly-projecting catch means at the open end, said cap having a top wall comprising:

(a) an annular platform having peripherally-extending collar means depending from its bottom surface, the collar means gauged to fit the open end of the receptacle for tight frictional engagement therewith and, said collar means having a latching ring having latch means gauged for snap-fit engagement with the catch means of said receptacle;

(b) means for removing said latching ring from said cap; and (c) said platform having an annular filler opening therein, and a closure being provided for said opening.

13. The invention according to claim 12 in which said latching ring has an inner diameter substantially the same as the outside diameter of said receptacle.

14. The invention according to claim 12 and said collar means including an inner collar having an outer diameter substantially the same as the inside diameter of said receptacle.

15. A closure cap according to claim 12 wherein the filler opening is surrounded by a depending collar on the under side of the platform, said collar having an internal peripheral latch, and said closure plug having peripheral external catch adapted to engage said latch when said closure plug is seated in said filler opening.

16. A closure cap according to claim 15 wherein the collar of the filler opening is closed at its bottom by a transverse wall adapted for penetration by a needle.

17. A closure cap according to claim 12 wherein the top wall of said cap has a radial tongue extending from its periphery, and said closure plug is attached on said tongue in position to engage in said filler opening when the tongue is folded inwardly and over said top wall.

18. A closure cap according to claim 17, wherein the top wall of the cap is provided with means to receive the tongue and peripherally enclose the same substantially flush with its upper surface when said plug is engaged in the filler opening so as to prevent insertion of a pry under the margin of the tongue for removal of the plug.

19. A closure cap according to claim 18 together with the platform having a peripherally-extending wall projecting from its upper surface and said wall having an inner surface wherein said tongue receiving and enclosing means comprises bars projecting from the upper surface of said top wall and extending parallel and immediately adjacent to closely receive the side edges of the tongue, and the length of the said tongue is made so as to extend beyond the closure plug to substantially reach the inner surface of the peripherally-extending wall projecting from the annular platform.

20. A closure cap according to claim 19 wherein the peripherally-extending wall is knurled to provide a firm gripping surface to facilitate the removal of the cap from the annular receptacle.

21. A closure cap according to claim 12 wherein said closure plug is a separate and independent element for locked insertion into the filler opening.

22. A closure cap according to claim 12 wherein means is provided on said top wall close to the periphery of said filler opening to prevent insertion of a pry for removal of said closure plug.

23. A closure cap according to claim 22 wherein the closure plug is provided with a head to seat on the filler opening and said pry insertion prevention means close to the periphery comprises an upstanding rim of substantially the same height as the thickness of said head and peripherally surrounding said head.

24. A closure cap according to claim 12 wherein the means for removing said latching ring comprises a pull tab formed at an end of said latching ring whereby the latching ring can be broken away from the cap and torn away peripherally of the receptacle.

25. A tamper-resistant closure cap for a receptacle open at one end and having a peripheral outwardly projecting catch means at the open end, said cap having a top wall comprising:

(a) a cylindrical platform having a pair of radially-spaced, peripherally-extending collars depending from its bottom surface for extension on either side of the open end of the receptacle, the inner of said depending collars having an outer diameter substantially the same as the inside diameter of said receptacle and the outer one of said depending collars being gauged to fit the open end of the receptacle and having latch means on its inner surface gauged for snap-fit engagement with the catch means of said receptacle; and (b) means for removing the outer one of said depending collars of said closure cap, and (c) the top wall having an annular filler opening therein, and a closure plug is provided for said opening.

* * * * *